US009380842B1

(12) United States Patent
Bigelow

(10) Patent No.: US 9,380,842 B1
(45) Date of Patent: Jul. 5, 2016

(54) WATCH BAND TOOL

(76) Inventor: Daniel R. Bigelow, Walker, MI (US)

( * ) Notice: Subject to any disclaimer, the term of this patent is extended or adjusted under 35 U.S.C. 154(b) by 421 days.

(21) Appl. No.: 13/449,415

(22) Filed: Apr. 18, 2012

Related U.S. Application Data

(60) Provisional application No. 61/512,400, filed on Jul. 27, 2011, provisional application No. 61/476,827, filed on Apr. 19, 2011.

(51) Int. Cl.
*A44C 5/00* (2006.01)
*A45C 11/00* (2006.01)
*A44C 5/24* (2006.01)

(52) U.S. Cl.
CPC ..... *A44C 5/24* (2013.01); *Y10T 24/2155* (2015.01)

(58) Field of Classification Search
CPC ..... A44C 5/00; A44C 5/24
USPC ..... 224/164, 165, 166, 167, 168, 171, 176, 224/174, 175; 81/3.55
See application file for complete search history.

(56) References Cited

U.S. PATENT DOCUMENTS

| | | | | | |
|---|---|---|---|---|---|
| 1,578,468 | A | | 3/1926 | Rankin | |
| 1,591,295 | A | * | 7/1926 | Brasier | A44C 5/2042 224/176 |
| 1,692,079 | A | * | 11/1928 | Alo | 24/71 J |
| 1,700,489 | A | * | 1/1929 | Dalo | 24/71 J |
| 1,985,835 | A | * | 12/1934 | Prestinari | 24/71 J |
| 2,394,856 | A | * | 2/1946 | Hickman | A44C 5/24 224/164 |
| 2,444,360 | A | * | 6/1948 | Mauch | 24/71 J |
| 2,457,200 | A | * | 12/1948 | Bikoff | 24/71 J |
| 2,499,102 | A | * | 2/1950 | Levine | 24/71 R |
| 2,677,864 | A | * | 5/1954 | Nielsen | A44C 5/14 24/265 R |
| 2,749,634 | A | * | 6/1956 | Billett et al. | 40/633 |
| 2,807,085 | A | | 9/1957 | Combs | |
| 3,010,627 | A | * | 11/1961 | Hoover | 224/219 |
| 3,175,233 | A | * | 3/1965 | Caravella | 7/152 |
| 3,478,537 | A | * | 11/1969 | Roger et al. | 63/4 |
| 3,665,564 | A | * | 5/1972 | Oka | 24/265 WS |
| 3,699,616 | A | * | 10/1972 | Kalinsky | 24/71 J |
| 3,900,934 | A | * | 8/1975 | Luft et al. | 24/265 WS |
| 4,078,272 | A | * | 3/1978 | Mahon, III | 24/186 |
| 4,106,677 | A | * | 8/1978 | Helmso et al. | 224/219 |
| 4,135,267 | A | | 1/1979 | McKinney, Sr. et al. | |
| 4,384,390 | A | | 5/1983 | Hayakawa | |
| 4,414,714 | A | * | 11/1983 | Kostanecki et al. | 24/265 WS |
| 4,521,939 | A | * | 6/1985 | Chabot et al. | 24/188 |
| 4,529,111 | A | | 7/1985 | Hayakawa | |
| 4,753,377 | A | | 6/1988 | Poluhowich | |
| 5,208,929 | A | * | 5/1993 | Chou | 7/101 |
| 5,217,150 | A | | 6/1993 | Chen | |
| 5,609,280 | A | | 3/1997 | Smith | |
| 5,609,281 | A | * | 3/1997 | West | 224/163 |
| 5,927,577 | A | * | 7/1999 | Braun | 224/176 |

(Continued)

FOREIGN PATENT DOCUMENTS

| | | | | | |
|---|---|---|---|---|---|
| JP | 07163409 | A | * | 6/1995 | A44C 5/24 |

*Primary Examiner* — Justin Larson
*Assistant Examiner* — Lester L Vanterpool
(74) *Attorney, Agent, or Firm* — Gardner, Linn, Burkhart & Flory, LLP

(57) ABSTRACT

A watch band for a watch includes at least two band portions, a latch selectively closing the band portions to secure the watch to a wrist of the user, and a tool assembly formed at the latch. The tool assembly includes one or more of an implement holder that is adapted to hold at least one implement, a fingernail file, a fingernail and thread trimmer, a bottle opener, a cord cutter and/or a screwdriver.

19 Claims, 4 Drawing Sheets

(56) References Cited

U.S. PATENT DOCUMENTS

| | | | | |
|---|---|---|---|---|
| 7,125,145 | B2 | 10/2006 | Gardiner et al. | |
| 7,359,287 | B2 | 4/2008 | Baroche | |
| 7,370,558 | B1 * | 5/2008 | Chenelia | 81/3.4 |
| 7,447,118 | B1 | 11/2008 | Matos | |
| 7,617,748 | B1 * | 11/2009 | Chenelia | 81/3.55 |
| D622,178 | S | 8/2010 | Kelleghan | |
| 8,001,657 | B2 * | 8/2011 | Giordano | 24/71 J |
| 8,205,527 | B2 * | 6/2012 | Chenelia | 81/3.55 |
| 2007/0056117 | A1 | 3/2007 | Gardiner et al. | |
| 2007/0084892 | A1 | 4/2007 | Korlath | |
| 2007/0163393 | A1 * | 7/2007 | Ondeck et al. | 81/3.57 |
| 2008/0127782 | A1 | 6/2008 | O'Brien | |

* cited by examiner

WATCH BAND TOOL

CROSS-REFERENCE TO RELATED APPLICATIONS

This application claims priority from U.S. provisional patent application Ser. No. 61/476,827, filed on Apr. 19, 2011, and U.S. provisional patent application Ser. No. 61/512,400, filed on Jul. 27, 2011, the disclosures of which are hereby incorporated herein by reference in their entirety.

BACKGROUND OF THE INVENTION

The present invention is directed to a personal item that provides comfort, convenience, and utility and, in particular, to such a personal item that is worn by a user.

Most watches are simple timepieces while others add further timing functions, such as chronograph, tides, and the like. A few watches add other accessories, such as lights, compass, and the like. However, these accessories are normally integrated in the watch case.

SUMMARY OF THE INVENTION

The present invention incorporates additional functions and features in the watch band. The features added by this invention are common items for daily use. Often, these functions are single-use devices, or may be part of a multi-function pocket knife, or a "Swiss Army" pocket tool, or a "Swiss card" normally carried in a wallet or purse. Providing the functions in a watch band increases the utility to the user. A pocket is not required to carry a separate item, such as a pocket knife. Separately carried items tend to be lost more readily than a wrist watch.

Also, when travelling with public transport, nothing resembling a knife has to be brought through the airport security checkpoint. This saves the owner inconvenience and delay. Furthermore, the cost to produce a common-function watch band is lower than making a watch band and pocket tool separately. Also, by incorporating additional functions and features in a commonly worn accessory, these functions and features are available in an article that is not easily lost.

Thus, the present invention provides an apparatus that combines a wrist watch band with several integrated tools for the user, including, for example, a fingernail file, a fingernail and thread trimmer, a bottle opener, a tool holder for a toothpick, tweezers and screwdrivers, a cord cutter, and a screwdriver, and the like.

DESCRIPTION OF THE PREFERRED EMBODIMENT

Figure 3:
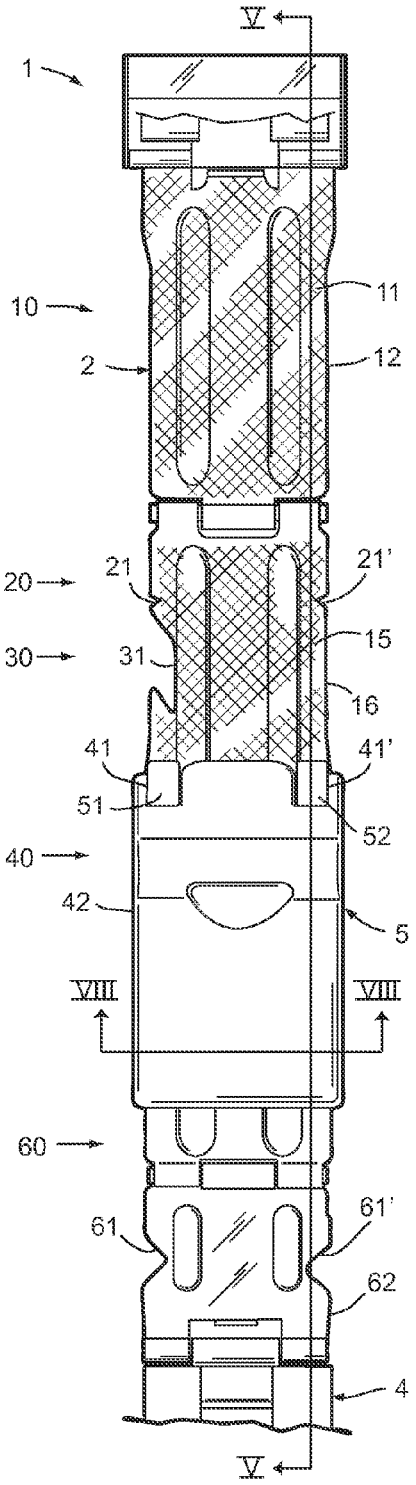
FIG. 3 is a top plan view of the watch band of FIG. 1, with its latch, or clasp, shown in an open position.
Figure 4:
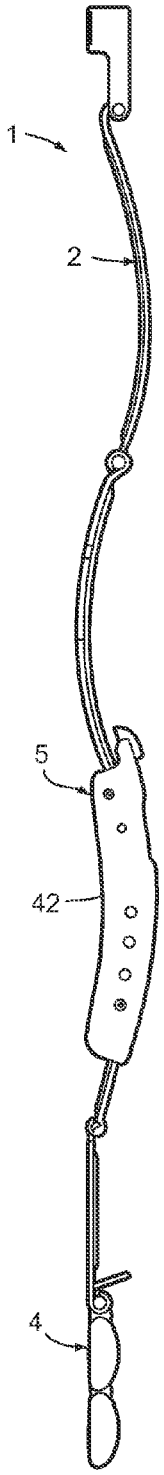
FIG. 4 is a side elevation of the watch band in FIG. 3.
Figure 5:
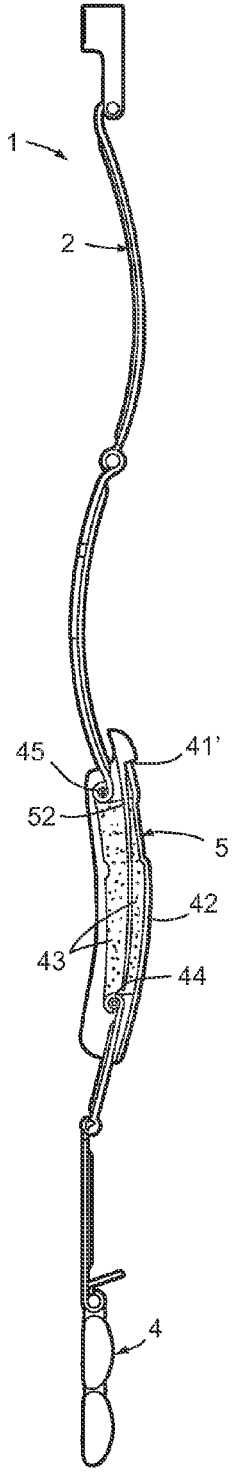
FIG. 5 is a sectional view of the watch band in FIG. 1 taken along the lines V-V in FIG. 3.
Figure 6:
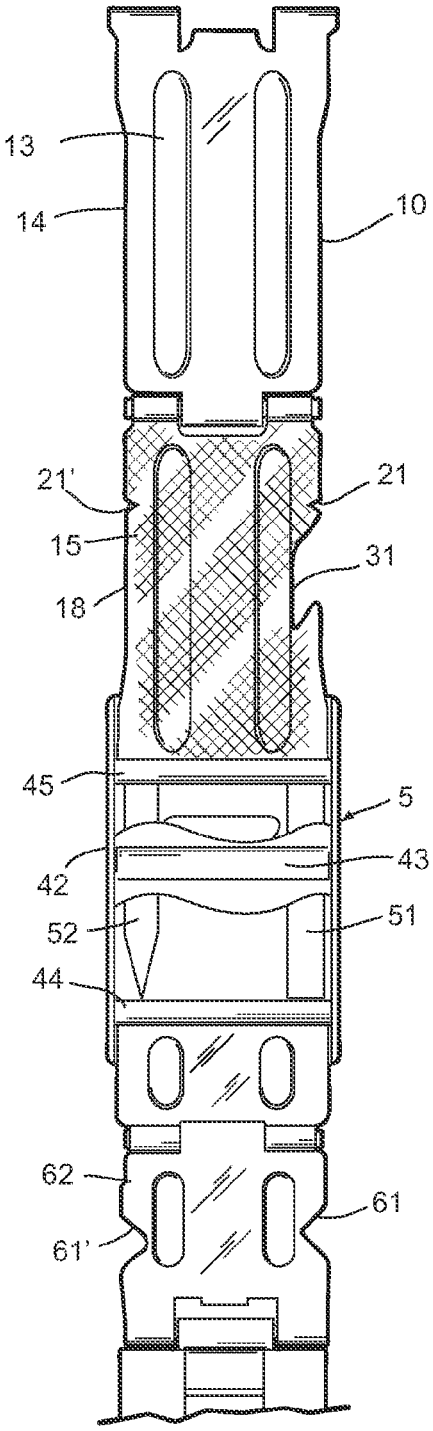
FIG. 6 is a bottom plan view of the watch band in FIG. 1.
Figure 7:
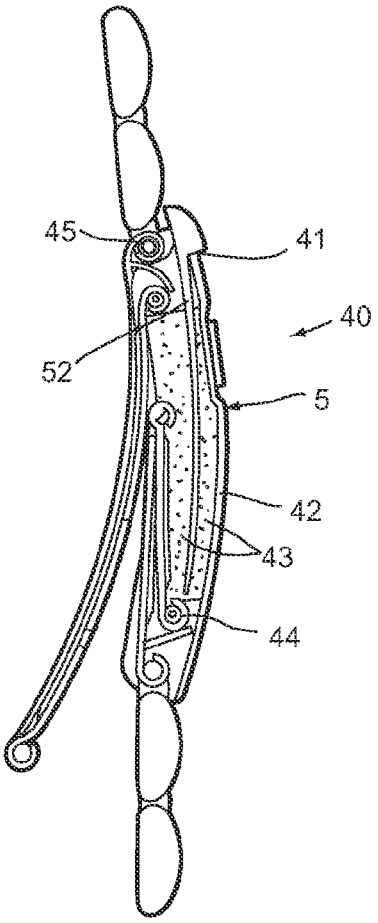
FIG. 7 is an enlarged view of the watch band in FIG. 6 with the clasp in a closed position.
Figure 8:
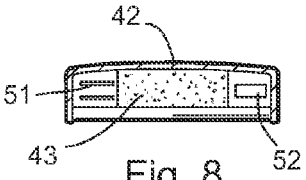
FIG. 8 is a sectional view taken along the lines VIII-VIII in FIG. 3.

Referring now to the drawings and the illustrative embodiments depicted therein, a watch band assembly 1 for use with a conventional watch (not shown) includes band portions 2 and 4 and a latch or clasp 5. FIG. 3 shows clasp 5 with a fingernail file 10 constructed using textured surfaces 11 and 15 provided on formed metal hinges 12 and 16, respectively. FIG. 3 also shows a fingernail and thread trimmer 20, bottle opener 30, and cord cutter 60 constructed in the hinges. Watch band assembly 1 also includes an implement holder, such as a tool holder 40 defined by a plastic insert 43 that provides internal support for tools such as a toothpick 52, tweezers 51, or the like.

Plastic insert 43 is combined with rectangular notches 41, 41' in the formed metal latch 42 to provide internal support for storage of toothpick 52 and tweezers 51.

Figure 10:
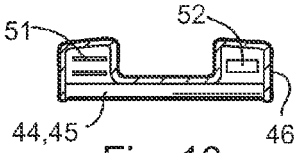
FIG. 10 is a sectional view taken along the lines X-X in FIG. 9.
Figure 9:
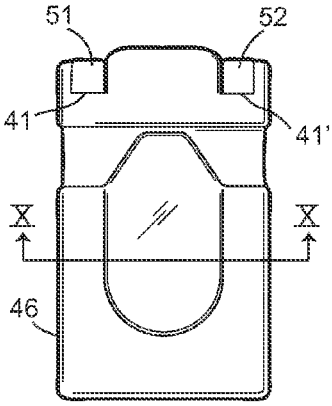
FIG. 9 is a top plan view of the clasp portion of a watch band in an alternate configuration made from only formed metal and not with a plastic insert.
Figure 11:
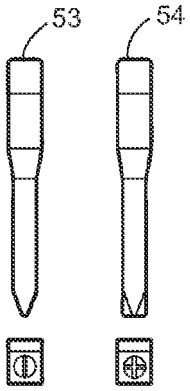
FIG. 11 is a side elevation of regular and Phillips screwdriver tools to be held in the same manner as a toothpick and tweezers.
Figure 12:
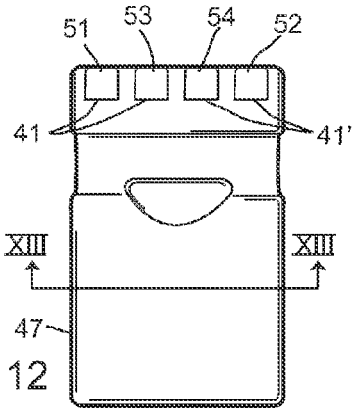
FIG. 12 is the same view as FIG. 9 of an alternate embodiment of the clasp made from die-cast or machined solid metal.
Figure 14:
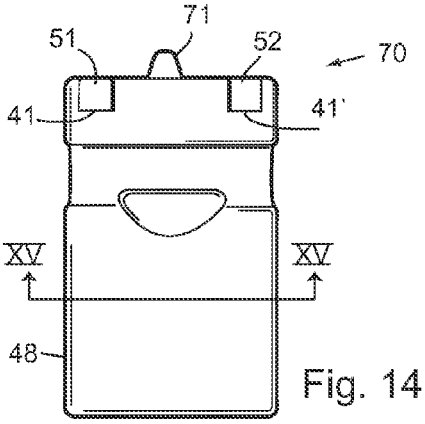
FIG. 14 is the same view as FIG. 12 with yet another alternative embodiment of the latch made from die-cast or machined solid metal.

In an alternate embodiment of the internal support illustrated in FIGS. 9 and 10, the latch itself is formed exclusively of metal with formed metal tracks to support the sides of tools, such as toothpick 52 and tweezers 51. FIG. 11 also includes an alternate embodiment of the internal support in which the die-cast or machined solid metal is constructed in such a way that it provides support of the sides of the tools. FIG. 12 illustrates four tools instead of only two as in other figures.

Figure 1:
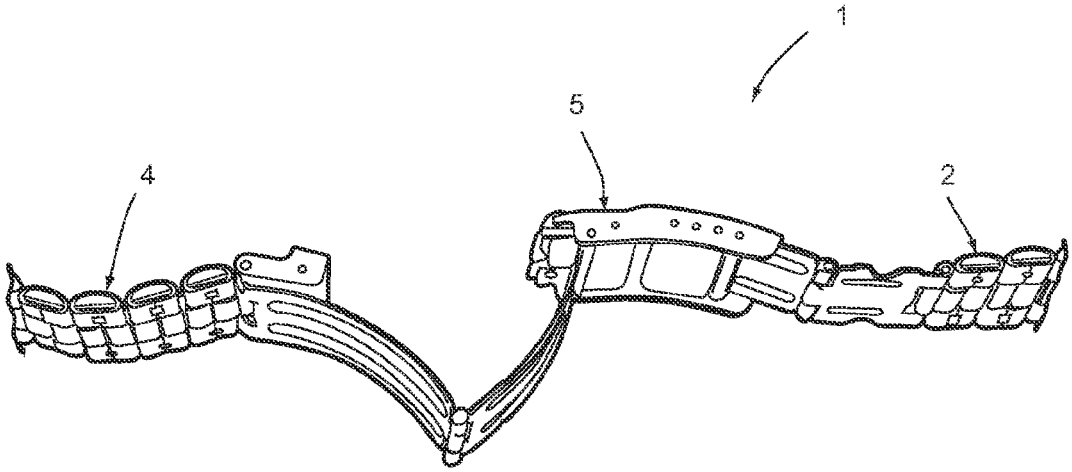
FIG. 1 is a perspective view of a watch band, according to an embodiment of the invention, with the latch, or clasp, in an open position.
Figure 2:
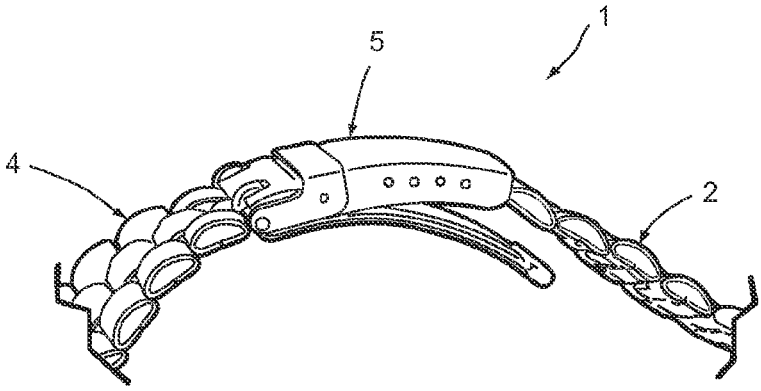
FIG. 2 is the same view as FIG. 1 with the clasp in a closed position.
Figure 16:
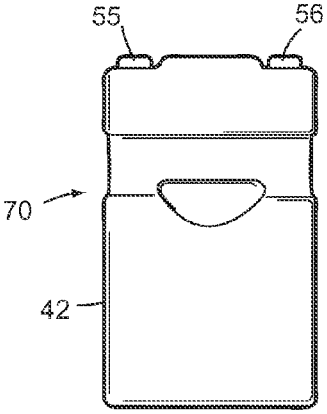
FIG. 16 is the same view as FIG. 14 of an alternate configuration of the latch not requiring notches on the latch.

FIG. 16 shows an alternate configuration of the latch, similar to the latch shown in FIG. 1, except that the toothpick and tweezers are formed differently, with a finger notch on the back side instead of on the front side, eliminating the need for the notches in the latch.

Figure 17:
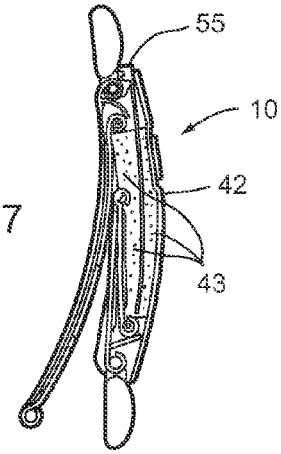
FIG. 17 is a side elevation of the latch in FIG. 16.

FIG. 17 shows a toothpick that is concealed behind the latch, supported between the latch (without notches) and the plastic insert, yet still accessible to the user from the top of the latch.

In order to make a fingernail file 10 integrated into watch band 1, textured surface 11, 15 is applied to large hinges 12, 16, 18 of the watch band, including the convex side of the large hinge, band side 12, and also including both sides of the large hinge, latch side 16, 18. The textured surface 11 is made from grooves pressed into the metal during forming by including features in the mold used to make large hinges 12, 16, 18, rather than just leaving the hinge smooth.

Alternatively, the grooves may be cut into the metal surfaces by a secondary operation after forming by moving a sharp edge of a harder material across the surface of the formed metal. The grooves are cut in one or more directions across the surfaces in two directions, each 30 degrees from perpendicular to the direction of the watch band, but any groove at any angle that makes a textured surface is sufficient. Textured surface 15 may furthermore be alternatively constructed using a powdered metal heat process, so that the resulting surface is rough, according to the size of the metal grit that is applied. Each of these methods is in common use today for producing standalone fingernail files. A smooth surface 13 remains on the concave side of the large hinge, band side 14.

Fingernails can be filed using the fingernail file 10 by opening watch band latch 5, opening the large hinge to expose textured surfaces 11, 15, and rubbing a fingernail back and forth across textured surfaces 11, 15. The combination of convex and concave surfaces is helpful for matching the inside and outside curves of a fingernail. The smooth surface on the concave side of the large hinge prevents the wearer's wrist from abrasion while normally wearing the watch band in a closed position.

Fingernail and thread trimmer 20 is integrated into watch band 1, with sharp notches 21, 21' that are cut into the large hinge, latch side 16, 18. Sharp notches 21, 21' may be cut with a triangular file, such as a 60-degree file, held at a 19-degree angle. Alternatively, the sharp notches may be a sharp edge of any other angle or shape that cuts fingernails and thread. This may include rectangular, semi-circular, trapezoidal, or any other shape. This may also, alternatively, be formed by a machining operation with a rotary cutting tool, which results in a concave rather than straight edge.

Fingernails can be trimmed with fingernail and thread trimmer 20 by opening the watch band latch 5, opening large hinge 12 to expose the sharp notches 21, 21', and forcibly pushing a fingernail into one of the sharp notches 21, 21' at a slight angle (nearly parallel) to the hinge, essentially "whittling away" the fingernail length. This operation is similar to using a knife blade to cut a fingernail, or even to sharpen a pencil, except that it cuts from two cutting surfaces that narrow down into the bottom of the notch. Threads can be trimmed with fingernail and thread trimmer 20 by opening watch band latch 5 and forcibly pulling the string at a sharp angle (nearly perpendicular) to the hinge 12, into one of the sharp notches 21, 21'.

Bottle opener 30 is integrated into watch band 1, with a bottle opener shape 31 cut into a large hinge, latch side 16, 18. Bottle opener shape 31 is normally made during the metal forming process by including the feature in the mold used to make the large hinge, latch side 16, 18, rather than just leaving the edge straight. Bottles can be opened with bottle opener 30 by opening the watch band latch 5, opening the large hinge to expose bottle opener shape 31, placing the shape on the edge of a capped bottle, and moving the large hinge in an upward direction. Repeated operations around the perimeter of the bottle cap may be necessary because this bottle opener does not tend to pull a large portion of the bottle cap with each operation. After repeated operations, however, the bottle cap is removed.

In order to make implement holder 40 integrated into watch band 1, several features are included in latch 5. Tools held in place can be toothpick 51, tweezers 52, regular screwdriver 53, Phillips screwdriver 54, or the like.

The preferred embodiment of tool holder 40 is to construct the latch of formed sheet metal 42 and make rectangular notches 41, 41' for placement of the tools. This construction is shown clearly in FIGS. 3, 5, 6, and 7. In order to hold the tools in place, an internal support is provided. This internal support is formed in one embodiment using a plastic insert 43 that follows the inside dimensions of a latch 42 and also includes a straight sliding surface for the tools 51, 52 to be inserted into openings in the plastic insert. The plastic insert 43 also is formed so that there is clearance for the hinges, which allows the latch to perform the function of keeping clasp 5 of watch band 1 closed. The plastic insert 43 is held in place by small hinge pin 44 and large hinge pin 45. Alternatively, plastic insert 43 may be held in place by an adhesive or glue so that removal of hinge pins 44, 45 from latch 42 does not result in disassembly of plastic insert 43 from latch 42.

A second embodiment of the tool holder 40 is to construct the latch of formed sheet metal with formed metal tracks 46 and also with the rectangular notches 41, 41', as described above. This construction is shown clearly in FIGS. 9 and 10. In this construction, latch 46 itself forms the internal support required to hold the tools in place, using the formed metal tracks, in conjunction with small hinge pin 44 and large hinge pin 45.

A third embodiment of tool holder 40 is to construct the latch of die-cast or machined solid metal with solid metal tracks 47, 48, with the rectangular notches 41, 41' as described above. This construction is shown clearly in FIGS. 12-15. In this construction, latch 47, 48 itself forms the internal support required to hold the tools in place, using the solid metal tracks, in conjunction with small hinge pin 44 and large hinge pin 45. Since this type of metal is much stronger than formed sheet metal, it is possible to provide room for additional tools, such as the regular screwdriver 53 and Phillips screwdriver 54, as shown in FIG. 11.

A fourth embodiment of tool holder 40 is to construct latch 47, 48 of injection molded or formed plastic or other non-metallic polymeric material, including all of the other features described above in the third embodiment.

Yet another alternate embodiment on any of the tool holders described above is to form the tools with a finger notch on the back side of the tool instead of on the front side, eliminating the need, for the rectangular notches 41, 41'. An example of this construction with a latch of formed sheet metal 42 and plastic insert 43 is shown clearly in FIGS. 16 and 17. Toothpick 55 and tweezers 56 are shown, but regular screwdriver 53, or Phillips screwdriver 54, could also be formed with this alternate shape. Furthermore, this alternate embodiment of the tool holder without rectangular notches can be used with any of the latch embodiments described earlier, including the latch of formed sheet metal with formed metal tracks 46, or the latch of die-cast or machined solid metal with solid metal tracks 47, 48, or the latch made of other materials.

In use, tools, such as a toothpick, tweezers, screwdrivers, or the like, may be held, carried, and readily accessed by being located in tool holder 40 on the watch band. Tools are held in place with friction, even when the latch is used to open the hinges when putting on and taking off the wristwatch. Tools may be removed from the tool holder 40, utilized, and replaced by the user without opening the watch band latch. When inserted into tool holder 40, the tools will tend to follow the internal concave surface of the latch and the plastic insert, and will naturally slide under the hinge pins.

Cord cutter 60 may be integrated into watch band 1 with one or more semicircular notches 61, 61' cut into the small hinge, band side 62. The semicircular notches 61, 61' may be cut with a circular file (round), held at a 19-degree angle. Alternatively, the semicircular notches may be a sharp edge of any other angle that cuts cords. This may also alternatively be formed by a machining operation with a rotary cutting tool, which results in a concave rather than straight edge.

Cords can be cut with cord cutter 60 by opening the watch band latch, opening the large hinge, and then opening the small hinge, in order to expose semicircular notches 61, 61', and forcibly pulling a cord vertically into one of the semicircular notches 61, 61'. Placing semicircular notch 61, 61' in the small hinges keeps these larger sharp surfaces from being regularly exposed to the wearer's wrist, as normally only the large hinges are used when putting on and taking off a wristwatch.

Figure 13:
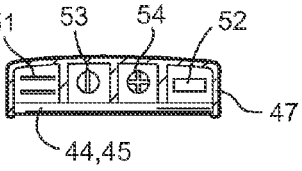
FIG. 13 is a sectional view taken along the lines XIII-XIII in FIG. 12.
Figure 15:
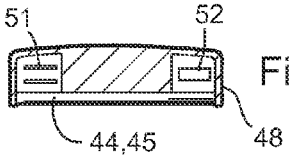
FIG. 15 is a sectional view taken along the lines XV-XV in FIG. 14.

In order to make screwdriver 70 integrated into watch band 1, screwdriver tip 71 is formed in the latch of die-cast or machined solid metal with solid metal tracks and screwdriver tip 48. This construction is shown in FIG. 13.

In use, screws may be tightened or loosened by opening the large hinge and folding the large hinge, latch side back over the latch, exposing the screwdriver tip. Next, the folded portion is grasped between the index finger and thumb, and the exposed screwdriver tip 71 is used in the same manner as a conventional screwdriver.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments.

The invention claimed is:

1. A watch band for a watch, comprising:
at least two band portions;
a latch selectively closing said band portions to secure the watch to a wrist of the user wherein said latch is made at least in part from sheet metal; and
a tool assembly formed at said latch wherein said tool assembly comprises an implement holder that is adapted to hold at least one implement and wherein said implement holder comprises notches in said sheet metal and wherein said implement holder further comprises a polymeric insert in said latch at said notches.

2. The watch band as claimed in claim 1 wherein said polymeric insert also provides a closure for retaining said latch in a closed state.

3. The watch band as claimed in claim 1 wherein said latch comprises at least two hinge pins and wherein said hinge pins hold said polymeric insert in place.

4. The watch band as claimed in claim 1 wherein said polymeric insert is held in place by an adhesive.

5. A watch band for a watch, comprising:
at least two band portions;
a latch selectively closing said band portions to secure the watch to a wrist of the user wherein said latch is made at least in part from solid metal formed with tracks for retaining implements; and
a tool assembly formed at said latch wherein said tool assembly comprises an implement holder that is adapted to hold at least one implement.

6. The watch band as claimed in claim 5 wherein said latch is formed at least in part with non-metallic material and wherein said non-metallic material forms said implement holder.

7. The watch band as claimed in claim 5 wherein said implement holder is adapted to hold tools formed with finger notches on the tool.

8. A watch band for a watch, comprising:
at least two band portions;
a latch selectively closing said band portions to secure the watch to a wrist of the user; and
a tool assembly formed at said latch, wherein said tool assembly comprises a fingernail file.

9. The watch band as claimed in claim 8 wherein said latch comprises at least one hinge and wherein said fingernail file is defined by a roughened surface of said hinge.

10. The watch band as claimed in claim 9 wherein said roughened surface faces inward when said latch is closed wherein the roughened surface is only exposed when the latch is open.

11. A watch band for a watch, comprising:
at least two band portions;
a latch that is selectively closed for closing said band portions to secure the watch to a wrist of the user; and
a tool assembly formed at said latch, wherein said tool assembly is substantially concealed behind the latch when the latch is closed, wherein said tool assembly comprises a fingernail and thread trimmer.

12. The watch band as claimed in claim 8 wherein said tool assembly comprises a bottle opener.

13. A watch band for a watch, comprising:
at least two band portions;
a latch selectively closing said band portions to secure the watch to a wrist of the user; and
a tool assembly formed at said latch, wherein said tool assembly comprises a cord cutter.

14. The watch band as claimed in claim 13 wherein said cord cutter is exposed for use when said latch is opened and not exposed when said latch is closed for use of the watch.

15. A watch band for a watch, comprising:
at least two band portions;
a latch that is selectively closed for closing said band portions to secure the watch to a wrist of the user; and
a tool assembly formed at said latch, wherein said tool assembly is substantially concealed behind the latch when the latch is closed, wherein said tool assembly comprises a screwdriver.

16. A watch band for a watch, comprising:
at least two band portions;
a latch selectively closing said band portions to secure the watch to a wrist of the user; and
a tool assembly formed at said latch, wherein said tool assembly comprises an implement holder that is adapted to hold at least one implement and said tool assembly further comprises at least two chosen from a fingernail file, a fingernail and thread trimmer, a bottle opener, a cord cutter and a screwdriver.

17. A watch band for a watch, comprising:
at least two band portions;
a latch that is selectively closed for closing said band portions to secure the watch to a wrist of the user; and
a tool assembly formed at said latch, wherein said tool assembly comprises a fingernail and thread trimmer.

18. A watch band for a watch, comprising:
at least two band portions;
a latch connected with both of said band portions, said latch selectively closed for closing said band portions to secure the watch to a wrist of the user and opened for moving the watch to or from the wrist of the user; and
a tool assembly formed at said latch, wherein said tool assembly is substantially concealed from view behind the latch when the latch is closed, wherein said tool assembly comprises a bottle opener.

19. A watch band for a watch, comprising:

at least two band portions;

a latch connected with both of said band portions, said latch selectively closed for closing said band portions to secure the watch to a wrist of the user and opened for moving the watch to or from the wrist of the user; and a tool assembly comprising an implement holder formed at said latch, wherein said implement holder comprises a polymeric insert at said latch, and wherein said tool assembly further comprises a screwdriver.

* * * * *